United States Patent [19]

Mellentin et al.

[11] 4,307,367

[45] Dec. 22, 1981

[54] BI-STABLE RELAY

[75] Inventors: Vernon A. Mellentin, Galesburg; Kenneth E. Davis, Chicago; Sheldon W. Mandel, Galesburg, all of Ill.

[73] Assignee: Magic Chef, Inc., Cleveland, Tenn.

[21] Appl. No.: 140,584

[22] Filed: Apr. 15, 1980

[51] Int. Cl.[3] ..... H01H 61/06

[52] U.S. Cl. ..... 337/95; 337/38; 337/104

[58] Field of Search ..... 337/38, 39, 53, 55, 337/70, 71, 76, 89, 90, 95, 96, 102, 104, 355, 365, 370; 361/26, 105; 219/413

[56] References Cited

U.S. PATENT DOCUMENTS

| | | | |
|---|---|---|---|
| 2,002,467 | 5/1935 | Blodgett | 337/104 |
| 2,324,161 | 7/1943 | Holmes | 361/26 |
| 2,446,831 | 8/1948 | Hottenroth, Jr. | 337/38 |
| 3,534,314 | 10/1970 | Ellenberger | 337/96 |

FOREIGN PATENT DOCUMENTS

| | | | |
|---|---|---|---|
| 1315851 | 12/1963 | France | 337/90 |

*Primary Examiner*—Harold Broome

*Attorney, Agent, or Firm*—Bacon & Thomas

[57] ABSTRACT

One reed of a pair of parallel reeds has a rod extending to opposite sides of the pair. A bimetallic snap disc can be heated to snap against one end of the rod and thus flex the reed to engage a contact on that reed with a contact on the other reed and thus close a circuit to be controlled. A resilient latch holds that reed in its flexed position, even after the disc cools and snaps back to its normal configuration, until a second snap disc is heated and pushes the rod and reed back to its open-contact position. A selectively operable switch serves to provide electric current to a selected one of a pair of resistance heaters, one heater being near each of the snap discs.

5 Claims, 1 Drawing Figure

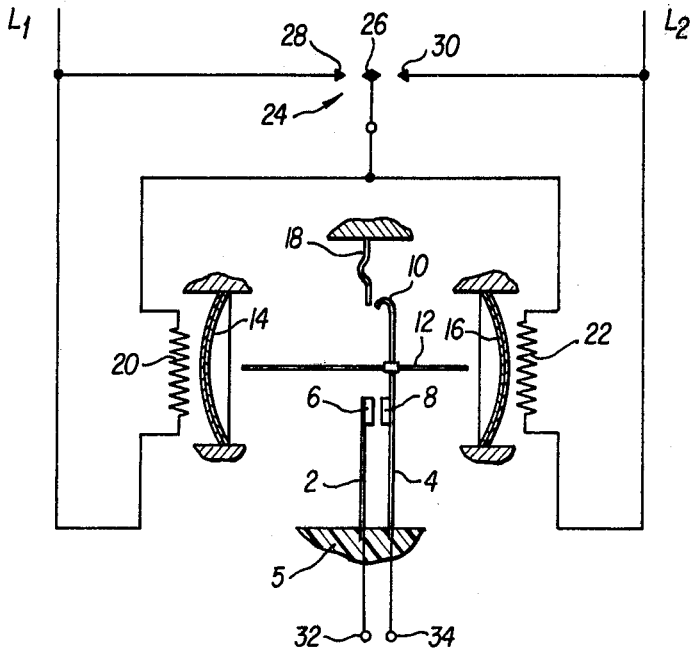
L1
L2
28
26
30
24
18
10
14
12
16
22
20
6
8
2
4
5
32
34

BI-STABLE RELAY

BACKGROUND OF THE INVENTION

This invention is in the field of electrical relays for controlling external circuits.

It has been proposed to provide relays or circuit controlling apparatus relying on the change of shape of thermally responsive bimetallic elements. However, in general, such devices have been of such nature that the external circuit is controlled in the desired manner only as long as heat is supplied to the thermally responsive elements. In this regard, see the following patents:

U.S. Pat. No. 2,769,938, Pauly;
U.S. Pat. No. Re. 22,973, Kurtz;
U.S. Pat. No. 3,551,868, Good;
U.S. Pat. No. 2,446,831, Hottenroth, Jr.;
U.S. Pat. No. 2,324,161, Holmes;
U.S. Pat. No. 2,914,644, Holtkamp;
British Pat. No. 830,157.

In the above patents, an electrical heater heats a bimetallic element to cause it to change shape and thereby open or close contacts for controlling an external circuit. However, as understood, none of the above patents disclose an arrangement that is simple in construction and yet is stable in either of its on or off positions without maintaining current through the electrical heaters.

SUMMARY OF THE INVENTION

The present invention comprises a bistable relay responsive to a single short pulse of current sufficient to heat a bimetallic element and cause it to snap from its normal configuration to a second configuration. Such snap action closes or opens contacts controlling an external circuit and the contacts remain in their open or closed condition even after the controlling thermal influence is removed and the snap acting device returns to its normal configuration.

It is, therefore, a principal object of this invention to provide a simple bistable relay adapted to achieve the foregoing and which is economical to produce and reliable in operation.

In a preferred form of the invention, a movable contact is carried by at least one flexible reed adjacent another contact adapted to be engaged thereby and wherein the reed normally assumes a position to hold the contacts apart. A rod is fixed to that reed and extends toward opposed thermally responsive snap discs. When one of the discs is heated to snap toward the reed, it pushes the same laterally and flexes it sufficiently to engage the contacts. A spring latch device holds the reed in that position even after the snap disc returns to its normal position and until a second snap disc is heated to forcibly push the reed free of the spring latch and back to its normal or open contact position.

BRIEF DESCRIPTION OF THE DRAWING

The single FIGURE of the drawing is a schematic representation of a bistable relay embodying the present invention.

DESCRIPTION OF A PREFERRED EMBODIMENT

In the drawing, numerals 2 and 4 indicate a pair of electrically conductive reeds each carrying a contact. The contact 6 is mounted on reed 2 whereas the contact 8 is mounted on reed 4 and the reeds are normally in such position that the contacts 6 and 8 are spaced from each other. At least the reed 4 is flexibly resilient and can be flexed toward the reed 2 to engage the contacts 6 and 8. As shown, reed 4 extends upwardly beyond the contacts 6 and 8 and at its upper end is provided with a curved end portion 10. Between the end 10 and the contact 8, the reed 4 is provided with a transverse rod 12 fixed thereto. The rod 12 is preferably substantially rigid and extends laterally of the reeds with its ends extending toward snap acting thermally responsive discs 14 and 16, respectively. The discs 14 and 16 may be identical, each being a bimetallic member of known construction and normally assuming the curved condition shown in the figure at ambient temperature. The snap discs 14 and 16 are of such nature that they assume the position shown at ambient temperatures but when heated will snap inwardly and bow inwardly toward the reeds 2 and 4. Each is arranged to bow inwardly sufficiently far to engage the rod 12 and forcibly flex reed 4, as will be described.

In a fixed position there is provided a spring or resilient latch element 18 having a projecting end projecting into the path of movement of the curved end 10 or reed 4. The spring latch element 18 is fixed on a suitable base upon which the discs 14 and 16 and the reeds 2 and 4 are mounted with at least the portions of the base on which the reeds are mounted being of electrical insulating material.

Adjacent each disc 14 and 16, outwardly thereof, there is an electrical resistance heater. Heater 20 is adjacent disc 14 and heater 22 is adjacent disc 16.

Characters L1 and L2 designate a power line having a suitable source of voltage and numeral 24 designates a selectively operable switch having a dentral movable contact 26 and a pair of opposed contacts 28 and 30. As shown, the contact 28 is connected to line conductor L1 whereas contact 30 is connected to line conductor L2. Central contact 26 is electrically connected to the adjacent ends of each of the resistance heaters 20 and 22 and the other ends of those heaters are connected to lines L1 and L2, respectively.

The reeds 2 and 4 are electrically connected to terminals 32 and 34 which represent an external circuit to be controlled by the relay.

The central contact 26 of switch 24 is movable under the influence of any suitable signal which may be either mechanical or electrical, depending upon the environment in which the relay is employed. When it is desired to close the external circuit represented by terminals 32 and 34, the central contact 26 is moved to the left to engage contact 28 and thus place resistance heater 22 across the lines L1 and L2. The heater is thus electrically heated and heat therefrom is transmitted to snap disc 16 which, when heated to a predetermined temperature, will snap to bow inwardly and in so doing will impinge on the end of rod 12 and flex reed 4 to the left sufficiently to engage its contact 8 with the contact 6. At this time the curved end 10 at the upper end of reed 4 snaps past the end of spring latch 18 and the reed 4 is thus held in its position flexed to the left and will remain so even after the snap disc 16 has cooled and snapped back to the position shown in the drawing. Thus, the relay is stable in its contact closed position until the contact 26 is moved to engage contact 30 which places resistance heater 20 across the lines L1 and L2 and the disc 14 then becomes heated and snaps inwardly to forcibly engage the rod 12 and forcibly flex reed 4 back to its open contact position. The latch element 18 is a releasable latching means that can be overcome by the action of the snapped discs as described.

From the foregoing it will be apparent that engagement of contact 26 will either contact 28 or 30 need only be maintained for sufficient time to produce the necessary heat at the snap discs 14 or 16 and may be thereafter opened and thus conserve energy while maintaining the relay in a stable condition.

While an electrical heater is shown for each of the snap discs, it is to be understood that other thermal influences could be employed to effect operation of the relay in particular environments where such thermal influences are readily available.

While a single specific embodiment of the invention has been shown and described, the same is merely illustrative of the principles involved and other embodiments may be devised within the scope of the appended claims.

What is claimed is:

1. A bistable relay comprising:

a pair of flexible reed members, each having a contact element engageable with the other when one reed is flexed toward the other;

a pair of snap-acting thermally activated members, one on each side of said pair of reeds and normally bowed away from said reeds;

one of said reeds having actuating means thereon engageable by either of said snap-acting members, when heated, to flex said one reed, one of said snap-acting members serving to flex said reed to engage said contacts and the other serving to disengage said contacts;

holding means, separate from said snap-acting members, for releasably holding said one reed, when flexed, with said contacts in engagement; and means for selectively heating either of said snap-acting means.

2. A relay as defined in claim 1 wherein said snap-acting members are bimetallic discs normally bowed, at ambient temperature, away from said reeds.

3. A relay as defined in claim 2 wherein said actuating means is a substantially rigid member having end portions extending from said one reed toward each of said discs.

4. A relay as defined in claim 1 wherein said holding means comprises a resilient latch element engageable with a free end of said one reed.

5. A relay as defined in claim 1 wherein said last-named means comprises an electrical heater element adjacent each of said snap-acting members and switch means for selectively energizing either of said heater elements.

* * * * *